US006234696B1

(12) United States Patent
Whittaker

(10) Patent No.: US 6,234,696 B1
(45) Date of Patent: May 22, 2001

(54) AUTOMATIC PAPER LOADER FOR A PRINTER

(75) Inventor: Sean E. Whittaker, Brooktondale, NY (US)

(73) Assignee: Transact Technologies, Inc., Wallingford, CT (US)

( * ) Notice: Subject to any disclaimer, the term of this patent is extended or adjusted under 35 U.S.C. 154(b) by 0 days.

(21) Appl. No.: 09/454,951

(22) Filed: Dec. 3, 1999

(51) Int. Cl.[7] ..... B41J 11/26
(52) U.S. Cl. ..... 400/613; 400/642
(58) Field of Search ..... 400/611, 613, 400/613.1, 619, 621, 642; 347/104; 242/564.4

(56) References Cited

U.S. PATENT DOCUMENTS

| | | | | |
|---|---|---|---|---|
| 4,663,638 | * | 5/1987 | Hiruse | 400/613 |
| 5,000,595 | * | 3/1991 | Koike et al. | 400/613 |
| 5,057,930 | * | 10/1991 | Curley | 400/613 |
| 5,060,076 | * | 10/1991 | Curley | 400/613 |
| 5,230,576 | * | 7/1993 | Sone | 400/613 |
| 5,579,043 | | 11/1996 | Patry . | |
| 5,613,787 | | 3/1997 | Passer et al. . | |
| 5,651,624 | | 7/1997 | Passer . | |
| 5,752,779 | | 5/1998 | Passer et al. . | |
| 5,887,999 | | 3/1999 | Smith et al. . | |
| 5,931,407 | * | 8/1999 | Uwagaki et al. | 242/564.4 |
| 5,993,093 | * | 11/1999 | Schoennauer et al. | 400/621 |
| 6,155,730 | * | 12/2000 | Nakayama et al. | 400/611 |

FOREIGN PATENT DOCUMENTS

| | | | | |
|---|---|---|---|---|
| 401145174A | * | 6/1989 | (JP) | 400/613 |
| 403213373A | * | 9/1991 | (JP) | 400/613 |
| 08 244304 | | 1/1997 | (JP) . | |

* cited by examiner

*Primary Examiner*—Eugene Eickholt
(74) *Attorney, Agent, or Firm*—Wall Marjama & Bilinski

(57) ABSTRACT

Apparatus for automatically loading paper from a supply roll into a printer. The printer includes a base and a cover hinged to the base. A contoured guide is mounted adjacent to a drive roll to form a paper path that converges from an upper entrance region to a lower exit region in the direction of drive roll rotation. A biased member is mounted in the top cover of the printer and is arranged to move into contact with the drive roll within the entrance region when the cover is closed. In practice, when the cover is open a run of paper from the roll is placed over the entrance region to the paper path. Closing the cover produces rotation of the drive roll and causes the biased member to force the paper into driving contact with roll producing a fold in the front section of the paper supply. The folded section passes through the paper path into a nip formed between the drive roll and pinch rollers whereupon the folded section is advanced through a printing station into a read out station.

14 Claims, 5 Drawing Sheets

AUTOMATIC PAPER LOADER FOR A PRINTER

BACKGROUND OF THE INVENTION

This invention relates to a point of sale printer of the type generally employed in the retail industry or in the restaurant industry.

Typically, the point of sale printer is a relatively small device utilizing impact or ink jet printing technology to produce a sales slip and cash receipt. In many of these printers the recording substrate is supplied from a spool which must be threaded through a feed path that transports the substrate through a printing station into a readout station where the image bearing section of the substrate is either automatically or manually separated from the spool.

Although the substrate upon which the receipt is printed can take many forms, it will herein be referred to as paper with the understanding that any type of support material such as heat sensitive or thermal paper that is known and used in the art can be employed in the practice of the present invention.

In busy restaurants or stores, the paper supply must be replaced at relatively short intervals. Replacing the spool has been a time consuming process because in many of the older printers, the leading edge of the paper strip must be hand-fed through the paper path and the feeding mechanism. Hand feeding in many cases cannot only be a time consuming and tedious process, but can also cause the paper to become misaligned in the feed mechanism whereupon the entire paper loading process must be repeated. This, of course, causes further delays and customer dissatisfaction.

In U.S. Pat. No. 5,579,043 to Patry, there is disclosed a small thermal printer that is designed to eliminate some of the problems associated with hand loading a spool of paper into a small printer. As disclosed in this patent, the thermal print head along with the drive motor and the main drive gear are mounted upon the fixed chassis of the machine. The print head coacts with a paper drive roll that is driven through a driven gear that meshes with the main drive gear to transport paper through the printing station. The drive roll, along with a spring loaded cutting blade is mounted in the cover of the machine. When the cover is raised to an open position, the drive roll is pulled away from the printing head along with the cutting blade and the drive roll gear is separated from the main drive gear. In effect, opening the cover of the machine separated the path through the printing station and cut off station along the line of travel of the paper. Accordingly, a new spool of paper can be drop loaded into the paper bin of the machine and the leading edge of the spool drawn over the printing head into the read out station. The cover is then closed over the leading edge of the paper thereby preparing the machine to begin a printing cycle.

Although the Patry device eliminates many of the problems associated with hand loading a paper spool into a printer, it nevertheless creates other problems. Separating the drive roll gear from the main drive gear of the drive system when the cover is opened can produce misalignment of the gear teeth so they will not properly mesh when the cover is closed. This, in turn, can cause undue stress on the drive system leading to early failure. In operation, the drive roll in turn is supported in biasing contact against a row of heating points mounted in the print head. The drive roll thus is constantly driven against the print head as the cover is opened and closed, which can damage the print head and again produce further misalignment of parts. Similarly, separating the cutting blade of the printer during the reloading of a spool can cause further alignment problems.

SUMMARY OF THE INVENTION

It is a primary object of the present invention to improve small printers of the type generally used in retail stores, restaurants and the like to record point of sale purchases.

It is a further object of the present invention to provide for the ease of loading a roll of paper into a small printer.

It is a still further object of the present invention to provide automatic drop-in paper roll loading feature to a small printer wherein the drive mechanism for the paper does not have to be separated during paper loading.

Another object of the present invention is to provide an automatic drop-in paper roll loader for a printer wherein the paper path of the machine does not have to be separated or broken apart during the loading operation.

These and other objects of the present invention are attained by means of an automatic paper loader for a printer utilizing paper from a supply spool. The printer includes a base containing the paper path and the drive mechanism for moving the paper along the paper path. A cover is hinged to the base which when opened allows a spool of paper to be dropped into a supply bin and the distal end of the roll to be placed over the entrance to the paper path. A bale or bar is pivotally supported on the inside of the cover. Closing the cover causes the bar to move the distal end of the supply roll into the entrance of the paper path and at the same time into driving contact with a drive roll in the drive mechanism. A fold is thus formed in the distal end of the roll and the fold region is advanced along the paper path through the printing station into the discharge station. Separating the folded section from the roll prepares the machine to begin a printing cycle.

BRIEF DESCRIPTION OF THE DRAWINGS

For a better understanding of these and other objects of the invention, reference will be made to the following detailed description of the invention which is to be read in association with the accompanying drawing, wherein.

DESCRIPTION OF THE INVENTION

Figure 1:
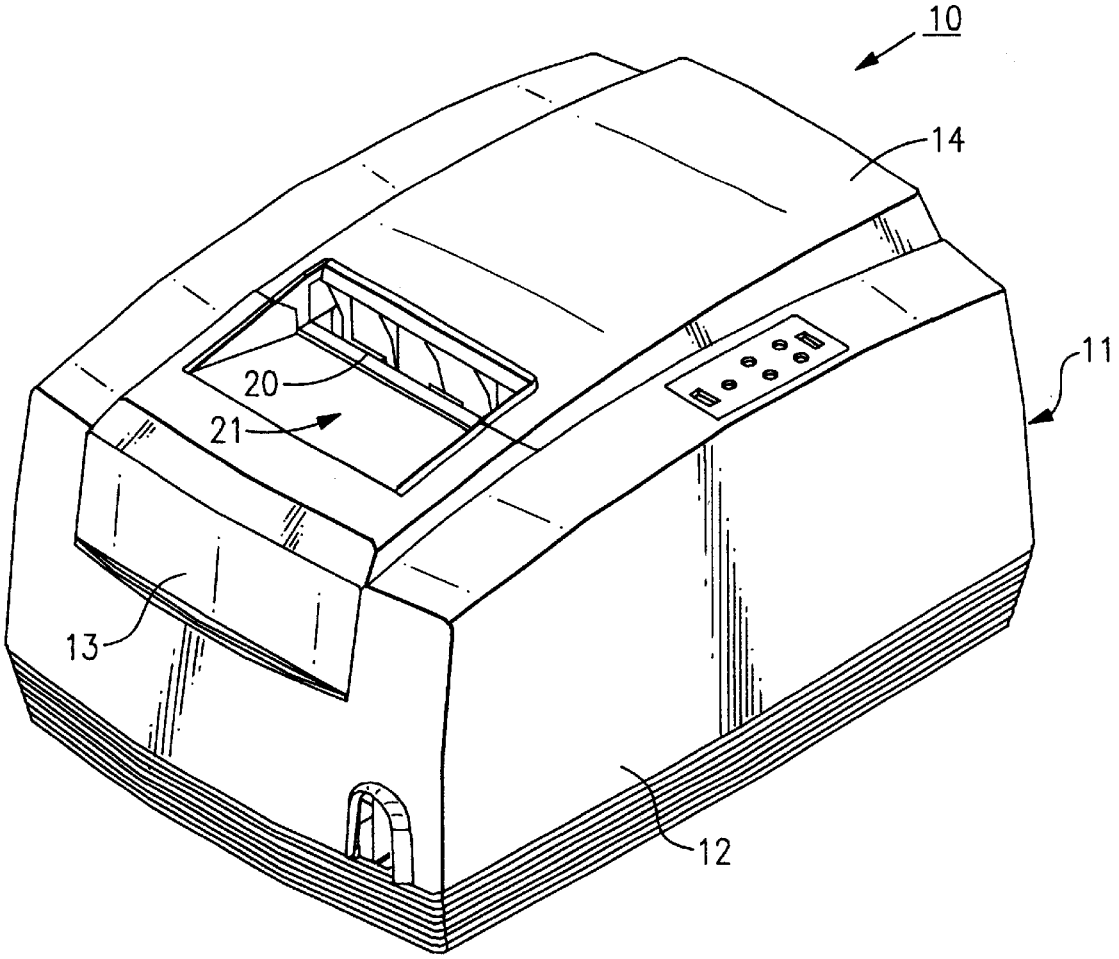
FIG. 1 is a perspective view of a small point of sale printer embodying the teachings of the present invention showing the covers of the printer in a closed condition.
Figure 2:
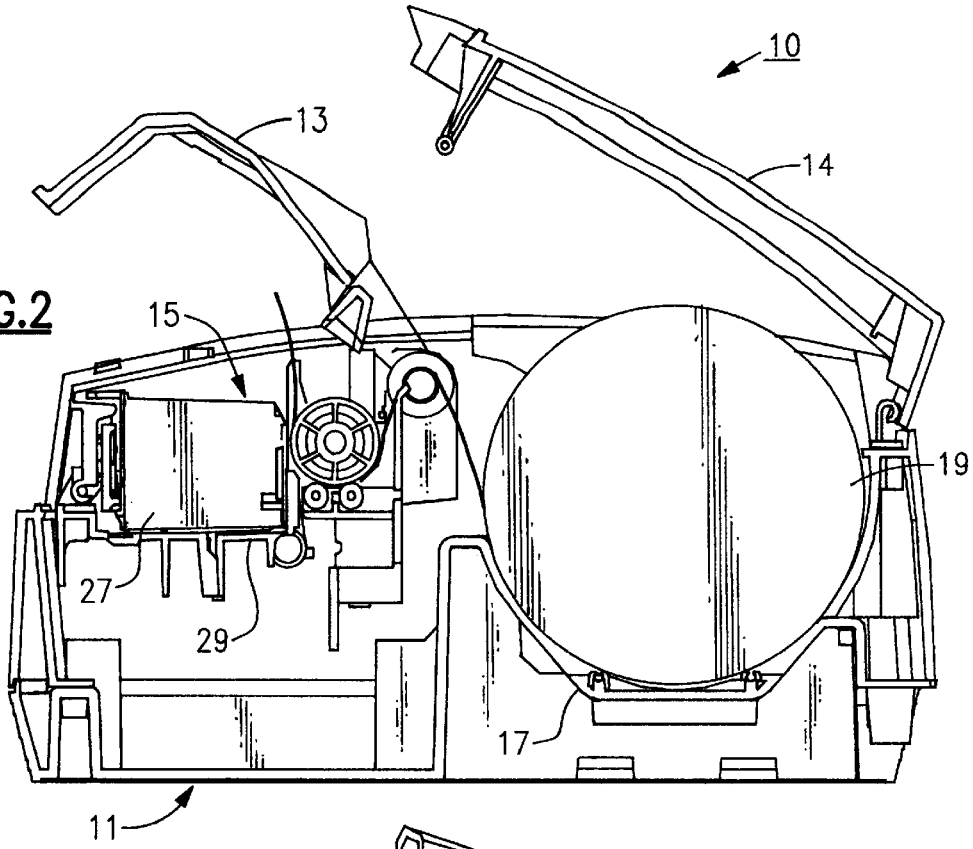
FIG. 2 is a side elevation of the printer illustrated in FIG. 1 with portions broken away to show internal parts of the machine and further illustrating the front and rear covers of the machine in an open condition.
Figure 3:
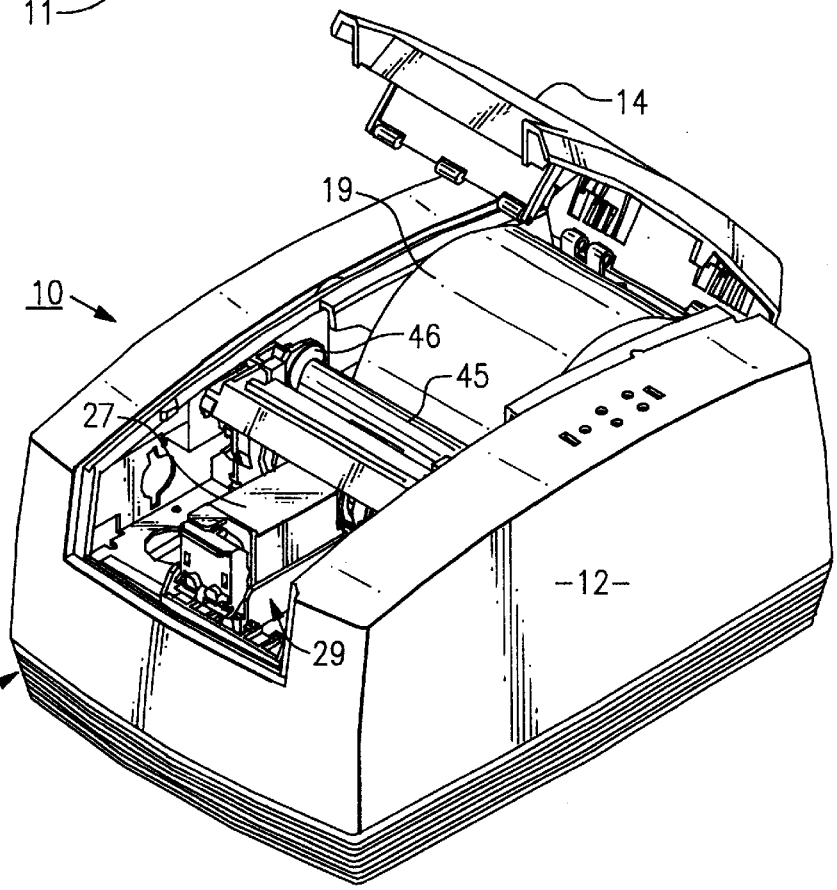
FIG. 3 is a front perspective view of the printer with the front cover removed and the rear cover opened.

Referring initially to FIGS. 1–3, there is shown a small printer, generally referenced 10, embodying the teachings of the present invention. Although the present invention will be described with specific reference to a small point of sale printer, it should be evident to one skilled in the art that the invention has broader application and can be employed in conjunction with other types of printers. The present printer 10 includes a housing 11 that contains a stationary base 12 and a pair of covers 13 and 14 that are pivotally mounted in the base so that they can be moved between a closed position as shown in FIG. 1 and an open position as shown in FIG. 2. The front cover 13 is positioned over the print out station 15 of the machine while the rear cover is positioned over the paper supply bin 17.

The supply bin 17 is arranged to accept a roll of paper 19 that provides the substrate upon which data that is provided to the printer from a micro processor or the like is printed. Although the term paper will be used herein in reference to the substrate material, it should be understood that the term is used in the broadest sense and can include any material such as thermal paper and the like that is known and used in the art. The present printer utilizes a drop-in concept wherein the spool of paper is simply dropped into the bin through the open rear cover and the leading edge of the roll is threaded through the paper feed path. As will be explained in greater detail below, the apparatus of the present invention is designed to automatically advance the leading edge of the roll through the printing station and then through an opening 20 (FIG. 1) in the housing into what will be herein referred to as the read out station 21 wherein the user can view the data printed upon the leading end of the paper. Although not shown, the printer can be equipped with either a manual or an automatic cut off device for separating the leading end of the roll containing the printed data from the body of the roll whereby a new printing cycle can be commenced.

Although the printer can employ any known printing technique, the present printer utilizes an ink jet system. An ink cartridge 27 is mounted upon a carriage 29 located immediately beneath the front cover 13 of the machine. The ink cartridge is equipped with one or more nozzles that are adapted to lay down an ink image upon the paper as it moves through the printing station. This type of printing technique is well known in the art and will not be discussed herein in any greater detail.

Figure 4:
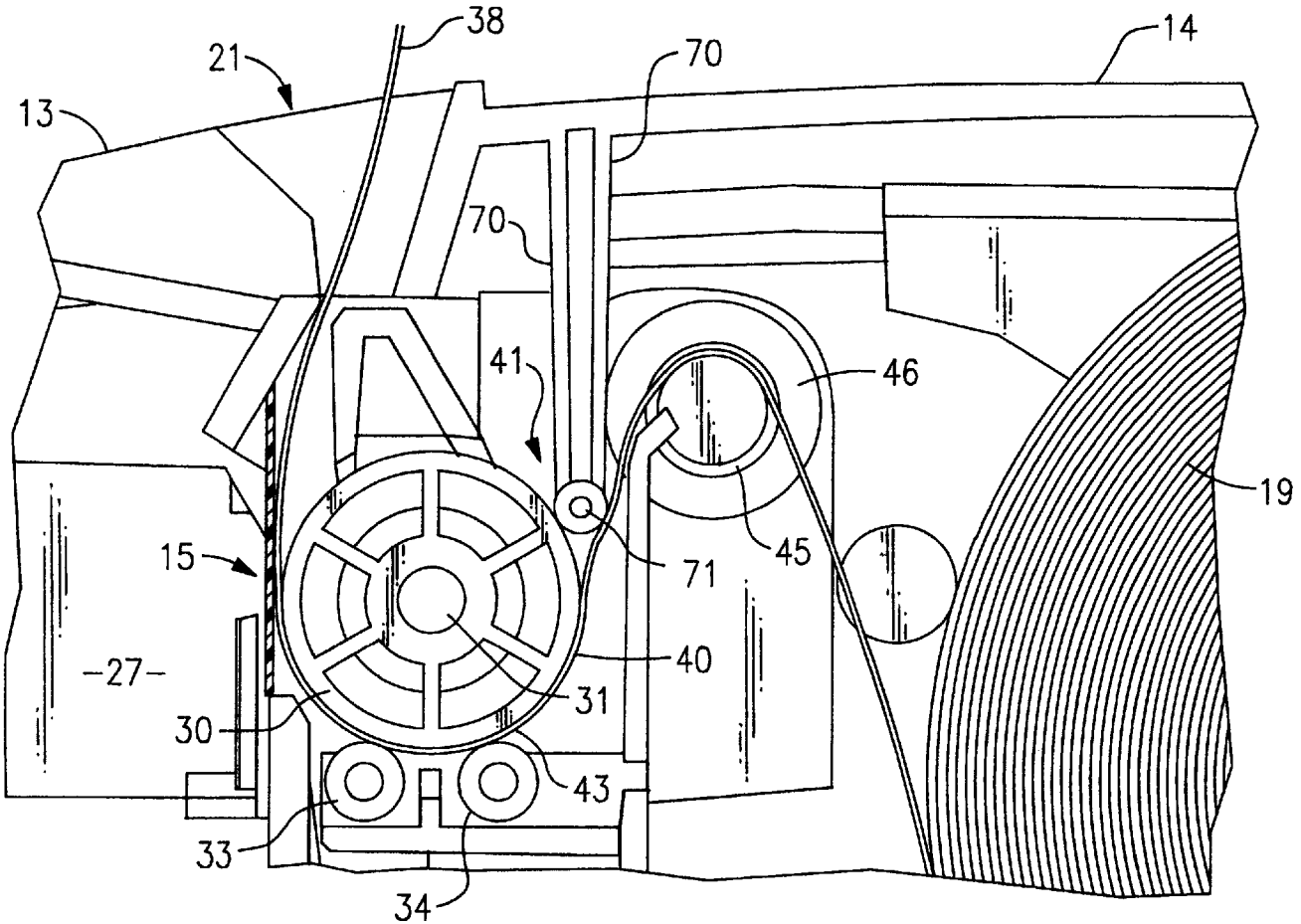
FIG. 4 is an enlarged partial side elevation showing the paper path through the printing station.
Figure 5:
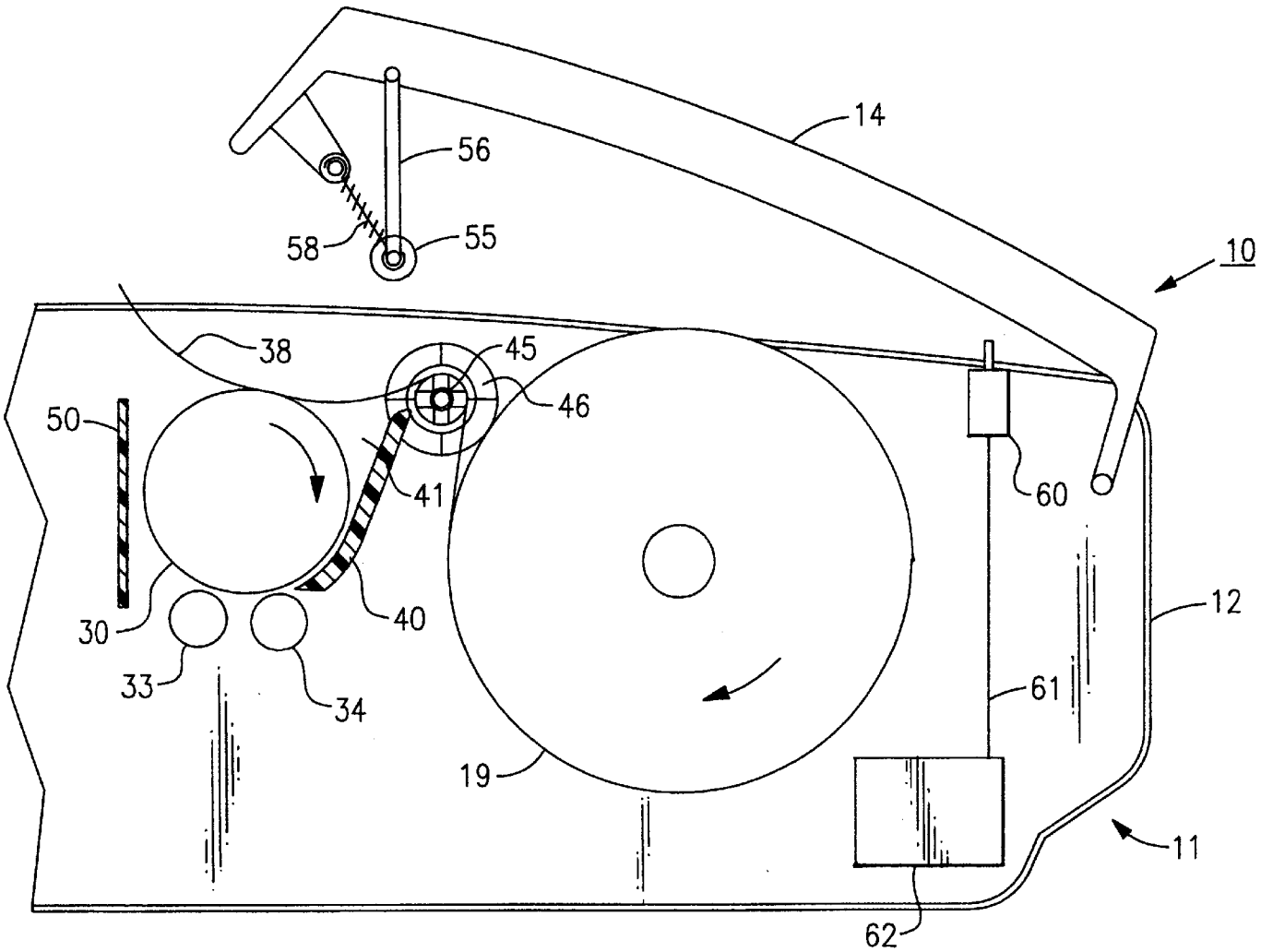
FIG. 5 is a partial schematic view illustrating a spool of paper prior to the paper being loaded into the printer with the covers in an open position.
Figure 6:
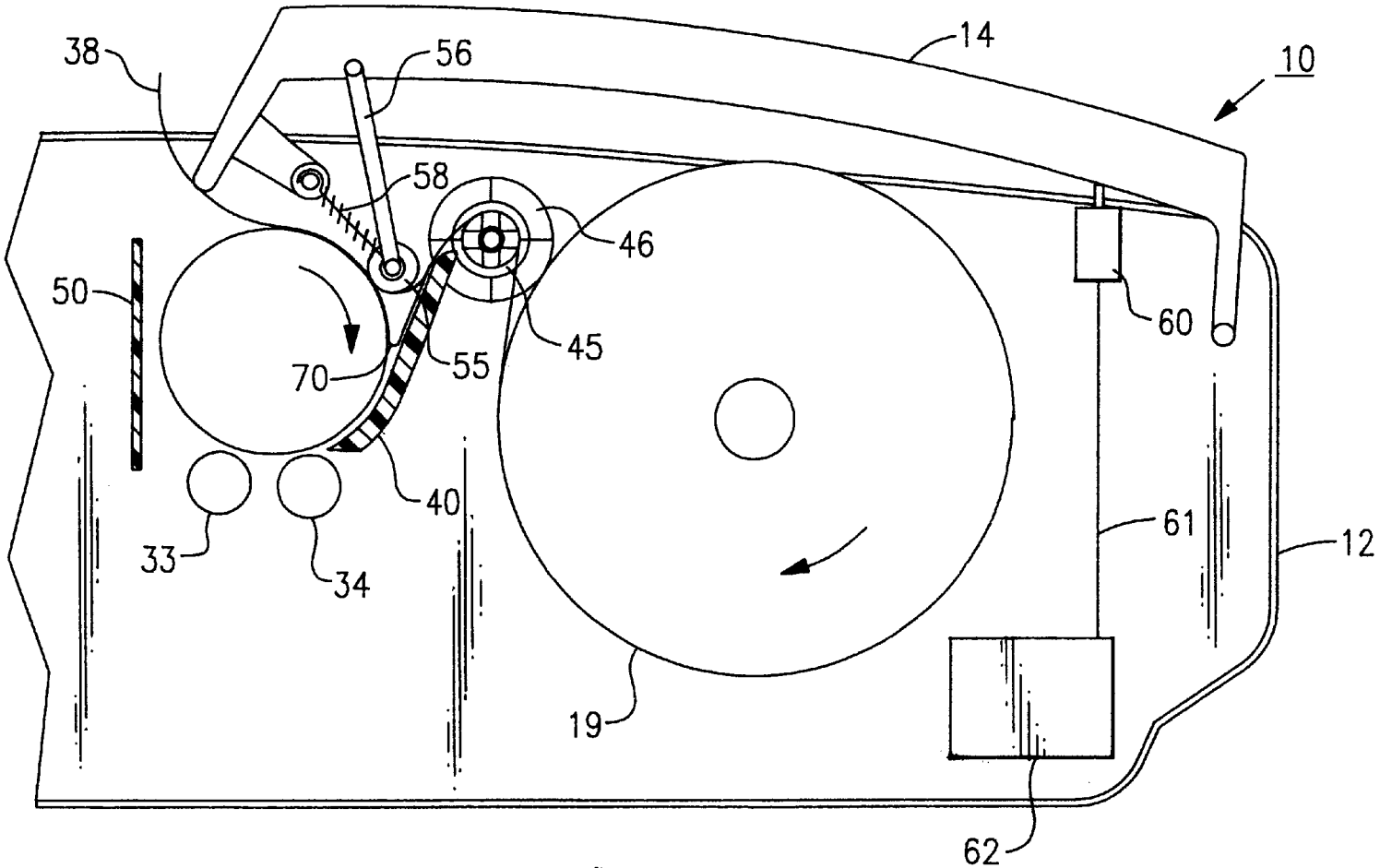
FIG. 6 is a partial schematic view similar to that of FIG. 5 showing the rear cover closed and paper being loaded into the printer.

Turning now to FIGS. 4–6 there is shown apparatus for automatically loading a new roll of paper into the printer. A main drive roll 30 is rotatably mounted in the base of the housing about a horizontal shaft 31. The shaft, in turn, is geared to an electrical motor (not shown) to rotate through the printing station at a desired speed. A pair of pinch rollers 33 and 34 are mounted beneath the main drive roll and are spaced apart from the main drive roll to provide a gap between the surfaces of the pinch rollers and the drive roll through which paper 38 from the supply roll is drawn.

The gap spacing is such that the paper in the gap is held securely against the main drive roll and is thus driven through the printing into the read out station as the main drive roll turns in a clockwise direction as viewed in FIG. 4. A guide plate 40 is mounted in the machine base adjacent to the drive roll which cooperates with the drive roll to define a paper path for guiding paper from the supply roll 19 into the nip of the pinch rollers. The guide plate is arranged so that the paper path converges from a wide entrance region 41 into a narrow exit throat 43 adjacent to the first pinch roller 34. An idler roll 45 having radially expanded end flanges 46 is rotatably mounted adjacent to the entrance 41 to the paper path. Paper from the supply roll is initially trained over the idler roll before passing into the entrance region of the paper path. The distance between the end flanges is about equal to the paper width to prevent the paper from skewing as it moves into the entrance region.

Paper leaving the nip formed by pinch roller 33 is guided upwardly by vertical baffle 50 through the printing station 15 into the read out station 21.

The method of automatically introducing a new roll of paper into the printer will be described in further detail with reference to FIGS. 5 and 6. Initially the rear cover is raised as illustrated in FIG. 2 and the spool of the spent roll is removed from the bin and a fresh roll 19 is dropped into the bin. The lead end section of the fresh roll is drawn upwardly and trained over the roller roll and passed over the entrance region of the paper path as viewed in FIG. 5. A biasing roller 55 is supported by a mounting bracket 56 in the cover 14 directly over the entrance region to the paper path. As illustrated schematically for explanatory purposes, the biasing roller is mounted on a U-shaped bracket and the roller is biased in a clockwise direction by a spring 58.

A sensor, in the form of a switch 60, is mounted in the base of the housing and provides a signal via line 61 to a microprocessor 62 indicating that the cover is opened. The microprocessor is arranged to idle the drive motor any time the cover is opened.

Closing the cover 14 brings the biasing roller downwardly into the entrance region of the paper path. When the cover is fully closed, as illustrated in FIG. 6, the leading section of the paper that has been brought over the entrance region is urged by the biasing roller into driving contact against the surface of the main drive roller. At the same time, switch 60 is closed instructing the microprocessor to begin a loading cycle whereupon the main drive roll is caused to turn in the direction indicated a predetermined number of degrees. The paper captured beneath the biasing roll is driven by the main drive roll into the entrance region of the paper path and a fold 70 is formed in the paper. The folded leading end of the paper is then captured between the pinch rollers and the drive roll and advanced through the printing station into the read out station whereupon the drive roll is inactivated and the folded end of the roll is removed preparatory to beginning a printing cycle.

Although the biased roller 55 is shown schematically as being biased by a tension spring, it is preferred that a biasing roll 71 be suspended from the cover 14 of the housing by resilient arms 70 (FIG. 4). The arms are arranged to apply pressure on biasing roll 71 mounted in the arms. Although a biasing roll 71 is used in the embodiment of the invention, a non-rotatable member can be used in its stead without departing from the teachings of the invention.

While this invention has been explained with reference to the structure disclosed herein, it is not confined to the details set forth and this invention is intended to cover any modifications and changes as may come within the scope of the following claims:

What is claimed is:

1. Apparatus for automatically loading paper from a paper supply roll into a printer that includes:

a housing containing a bin for holding a roll of supply paper and a drive roll arranged to rotate in one direction about a horizontal axis, a guide mounted adjacent a downwardly moving section of said drive roll to form a paper path therebetween, said paper path converging from a wide entrance region to a narrower exit region whereby the front section of a supply roll contained in said bin can be drawn over the top of said entrance region, a cover mounted over said entrance region that is movable between a first closed position against the housing and a second open position wherein a new roll of paper can be loaded into said bin, and biasing means mounted on said cover for moving into the entrance region of said paper path when said cover is moved from an open position into a closed position to hold a section of paper positioned over the entrance region in friction driving contact against said roll whereby a fold is formed in said section of the paper and is moved by said drive roll through said paper path.

2. The apparatus of claim 1 that further includes a pinch roller means mounted adjacent the exit region of the paper path for capturing paper exiting the paper path between said pinch roller means and the drive roll whereby the paper is advanced in the direction of rotation of said drive roll.

3. The apparatus of claim 2 wherein said pinch roller means includes at least two pinch rollers that are spaced apart along the direction of rotation of said drive roll.

4. The apparatus of claim 3 that further includes a printing station located downstream in the direction of rotation of said drum from said at least two pinch rollers.

5. The apparatus of claim 1 wherein said biasing means includes a biasing roller mounted in said cover upon a bracket and a spring means for urging the biasing roller toward the surface of said drive roller when said cover is in said closed position.

6. The apparatus of claim 1 wherein said biasing means includes a resilient support that extends downwardly from the cover and a contact member mounted in the distal end of said support that is arranged to force said section of paper into friction driving contact with said drive roll.

7. Apparatus for automatically loading paper from a supply spool into a printer that includes:

a housing containing a base and at least one cover movably mounted upon said base to move between an open position and a closed position against said base, a drive roll mounted for rotation about a horizontal axis within said base adjacent a printing station, drive means for rotating said drive roll in a given direction, pinch roller means positioned beneath the centerline of said drive roll within said base for forming a nip between the drive roll and said pinch roll means for holding paper passing through a printing station in friction driving contact against said drive roller, a contoured guide means mounted adjacent to the drive roll to create a paper path therebetween that converges in the direction of drive roll rotation from an upper entrance region above the center line of the drive roll and an exit region adjacent said pinch roller means, a paper supply roll mounted in said base adjacent the guide means whereby a run of paper positioned from the supply roll can be passed over the entrance region of the paper path when the cover is in an open position, a biasing member supported in said at least one cover that is arranged to move the run of paper over the entrance region of the paper path into friction driving contact with the drive roll so that the paper is folded as it moves through into the paper path, and sensor means for activating said drive means when the cover is brought to a closed position wherein the folded run of paper is moved into the nip and then advanced through said printing.

8. The apparatus of claim 7 that further includes a first front cover pivotally mounted in said base over said printing station and a second rear cover pivotally mounted over said entrance to the paper path and said bin, said biasing means being supported in said rear cover.

9. The apparatus of claim 8 wherein said front and rear covers coact when in said closed position to define a slot through paper moves between the printing station and the read out station.

10. The apparatus of claim 7 wherein said pinch roll means further includes at least two pinch rollers that are spaced apart along the direction of rotation of said drive roll.

11. The apparatus of claim 7 wherein said biasing means includes a biasing roller mounted in said cover upon a bracket and a spring means for urging the biasing roller toward the surface of said drive roller when the rear is in a closed position.

12. The apparatus of claim 7 wherein said biasing means includes a resilient support member that extends downwardly from said rear cover and a contact member mounted in the distal end of said support member that is arranged to force the run of paper located over the entrance of the paper path into friction driving contact with said drive roll.

13. The apparatus of claim 7 wherein said sensor means includes a normally open switch that is closed against the base.

14. The apparatus of claim 13 that further includes a microprocessor arranged to receive an input signal when said rear cover is closed and signal the drive means to initiate a paper loading cycle.

* * * * *